US006123394A

United States Patent [19]

Jeffrey

[11] Patent Number: 6,123,394

[45] Date of Patent: Sep. 26, 2000

[54] HYDRAULIC FRACTURING OF ORE BODIES

[75] Inventor: Robert Graham Jeffrey, Melbourne, Australia

[73] Assignee: Commonwealth Scientific and Industrial Research Organisation, Campbell, Australia

[21] Appl. No.: 09/259,703

[22] Filed: Mar. 1, 1999

[30] Foreign Application Priority Data

Mar. 2, 1998 [AU] Australia ..... PP2094

[51] Int. Cl.[7] ..... E21C 37/06

[52] U.S. Cl. ..... 299/16; 166/177.5; 166/308

[58] Field of Search ..... 299/10, 16, 20, 299/21; 166/177.5, 179, 308

[56] References Cited

U.S. PATENT DOCUMENTS

| | | | |
|---|---|---|---|
| 4,265,570 | 5/1981 | Choi et al. | 405/258 |
| 4,474,409 | 10/1984 | Trevits et al. | 299/16 |
| 5,472,049 | 12/1995 | Chaffee et al. . | |

FOREIGN PATENT DOCUMENTS

| | | |
|---|---|---|
| 992740 | 1/1983 | U.S.S.R. . |
| 1834972 | 8/1983 | U.S.S.R. . |
| 1129357 | 12/1984 | U.S.S.R. . |
| 1163004 | 6/1985 | U.S.S.R. . |
| 1164416 | 6/1985 | U.S.S.R. . |
| 1029677 | 8/1985 | U.S.S.R. . |
| 1234658 | 5/1986 | U.S.S.R. . |
| 108 519 | 5/1984 | WIPO . |
| 522 628 | 1/1993 | WIPO . |

OTHER PUBLICATIONS

D.E. Julin, et al.; "Block Caving"; *Underground Mining Systems and Equipment*; SME Mining Engineering Handbook; pp. 162–220, undated.

J.W. Summers, et al.; "A Study to Determine the Feasibility of High Pressure Water Infusion for Weakining the Roof"; *Proc. 2nd AAC Mining Symposium*; 1985; pp. 197–205.

*Primary Examiner*—David Bagnell
*Assistant Examiner*—Sunil Singh
*Attorney, Agent, or Firm*—Merchant & Gould, P.C.

[57] ABSTRACT

A method of mining that makes use of hydraulic fracturing. The method comprises fracturing an ore body hydraulically by introducing fluid rapidly into a bore or fissure in the ore body such that pressure in the bore or fissure builds up rapidly and it fractures the surrounding ore body. This enables the surrounding ore body to cave into a suitable space such as an undercut from which the ore can then be recovered. The method is particularly useful in block caving as a replacement for explosives.

13 Claims, 3 Drawing Sheets

Fracture at 127 m in D192
at Northparkes E26 Mine

HYDRAULIC FRACTURING OF ORE BODIES

BACKGROUND OF THE INVENTION

The present invention is concerned with hydraulic fracturing of ore bodies and, more particularly, with the hydraulic fracturing of ore bodies mined by caving especially block caving.

Caving is a technique of mining wherein an ore body or rock mass is undercut under a sufficient area that the material "caves" from the bottom of the undercut area, referred to as the "block". Broken material is progressively drawn off and the caving of the mass continues upward through the ore body. The rate at which this caving action progresses is dependent upon the rate at which broken material is drawn off.

Caving, where the ore body is suitable, gives a lower mining cost per tonne than any other underground method. In contrast to other methods there is relatively little drilling, blasting and rock support done per tonne of ore, but nevertheless the preparation of the blocks for caving requires considerable time and large expense. For this reason the technique is best suited to wide veins, thick beds or massive deposits of homogeneous ore, overlain by ground which will cave readily. Ore bodies where the ore is soft or highly fractured and breaks fine are most suitable.

In ore bodies that are marginally cavable it is possible that, instead of continuously caving, a stable arch can form if the rock mass is strong enough. It is then difficult to promote further caving and the stable arch must be broken up. This has been observed, for example, in the Urad mine in the late 1960's. Production started in July 1967 and about 40,000 square feet of a portion of the ore body 750 feet long and 300 feet wide was undercut. By November 1967 it was realised that there was a problem with caving, and in December 1967 it was discovered that a stable arch had formed and that there was no caving above the arch. From January 1968 to October 1968, drilling and blasting were tried in several unsuccessful attempts to bring down the arch. Although the arch was ultimately brought down in this way, it is estimated that the total cost of the operation was around $2,000,000.

The present invention seeks to reduce the cost of caving and provide a means of avoiding and/or overcoming problems associated with caving stronger rock by utilising the technique of hydraulic fracturing. Hydraulic fracturing is a technique used in the petroleum industry and more recently the mining industry but has not been successfully applied to caving. In the petroleum industry, hydraulic fracturing is used to connect the well to a larger volume of the reservoir rock formation through a conductive fracture, resulting in an increased rate of hydrocarbon production from a well. Hydraulic fracturing has also been used to fracture coal seams prone to gas bursts, to release the gas from the seam and avoid "bumping". A typical disclosure of such a process occurs in Russian patent application number 1234658.

Hydraulic fracturing and water infusion have also been used in coal mining as a way of weakening the rock immediately above the coal over mined out parts of the seam to cause this rock to fail and form gob or goaf as described by a paper titled "A Study to Determine the Feasibility of High Pressure Water Infusion for Weakening the Roof" by J W Summers and E Wevell that was presented at the $2^{nd}$ AAC Mining Symposium in 1985. Although fluid pressures of up to 9 megapascals were reached, the rate of fluid injection used was less than 5 liters/minute.

Moreover, hydraulic fracturing is a technique used in shaftless mining of minerals, wherein a rock formation is broken and then a leaching solution is injected into the deposit. The leaching solution is recovered and includes mineral values.

Russian patent application number 1164416 describes a process for preparing forward rock for driving which comprises injecting a mineral binder into drill holes in the rock, installing charges in the holes and detonating the charges, then pumping an aqueous surfactant solution into the same holes to hydraulically fracture the rock. This process speeds up heading operations by predisposing the forward rock to breakage. However, there is no disclosure of any caving technique in this patent and, in any event, hydraulic fracturing is only attempted after the rock has been first drilled and blasted.

Russian patent application number 1029677 discloses a process for rock breaking which consists of creating an additional free face, drilling a row of holes in the lock and breaking the rock out in slices onto the free face. However, before breaking the rock out, all holes in the block are hydraulically fractured. Once the rock has been hydraulically fractured it opens out and creates cracks to reduce pressure, and the equipment such as a wedge and piston and breaker jaws are used to break down the rock formation. The rock formation does not collapse under its own weight as in block caving.

Injection of water into the rock to reduce the effective normal stress in the rock was first tried independently by Northparkes Mines in late 1997, but this method had no effect on caving. The equipment used and techniques tried did not result in any hydraulic fractures forming.

SUMMARY OF THE INVENTION

According to the present invention there is provided a method of mining an ore body comprising the steps of:

(i) packing a bore or fissure in an ore body with packers to seal off a packed space defined by the packers and walls of the bore or fissure;

(ii) introducing fluid into the packed space at such a rate that it causes pressure to rapidly build up in the packed space and a substantial portion of the surrounding ore body to fracture;

(iii) allowing the ore body to cave into a suitable space; and (iv) recovering ore from the space.

The rate at which fluid is introduced into the packed space may be in a range from 100 to 4000 liters/minute and the pressure in the packed space may reach a level in a range from 2 to 50 megapascals. Preferably the fluid is water or a water based polymer gel.

Typically, the ore body is undercut and caves into the undercut, whereupon broken ore is progressively drawn off. The method of the present invention is suitable for use with front, panel, sub-level and block caving techniques.

Ideally, the ore body is hydraulically fractured before caving is initiated. However, hydraulic fracturing can continue throughout the caving process to ensure it proceeds in a proper fashion, or can be carried out to recommence caving if caving is interrupted. For example, if a stable arch forms which prevents caving, the arch can be broken down by hydraulic fracturing.

It is estimated that hydraulic fracturing costs 10 to 20 cents per tonne to prepare the ore body for caving and/or to break down a stable arch, whereas blasting costs around $1 per tonne.

An ore body which is not inherently suitable for caving can be hydraulically fractured to weaken or pre-condition it to allow the block caving technique to be used. Thus, marginal deposits can be mined by block caving when the process of the present invention is applied to them.

In order to hydraulically fracture an ore body one or more shafts is sunk into or adjacent to the ore body and a plurality of drill holes drilled into the ore body. Alternatively, the hydraulic fracturing work can proceed from drill holes drilled from the surface into the ore body. However, instead of introducing explosives as one would if blasting the ore body, large volumes of liquid are introduced to the drill hole under pressure. The apparatus typically used for hydraulic fracturing in other applications can be employed.

In general, hydraulic fracturing is achieved using a pair of inflatable packers spaced apart by a predetermined distance and held in this configuration by a spacer. The apparatus is capable of being introduced to a drill hole and includes a conduit passing through one of the packers into the space between the packers so that fluid can be introduced into the space. Once in position the packers are inflated by any suitable means so that they seal against the internal walls of the drill hole. A liquid such as water is introduced into the space between the packers through the conduit, and the pressure created within the space fractures the rock. Water continues to be introduced into the space between the packers for sufficient time to fracture the rock for some 30 to 50 metres or more from the drill hole. In order to fracture rock in a typical ore body water is pumped into a 3 inch diameter drill hole at a rate of 400 to 500 1/min for 15 to 30 minutes. The borehole size and injection rate can be varied over a wide range, provided the hydraulic fracture treatments are designed to produce fractures of sufficient size to weaken the rock to the extent required for block caving.

The technique can be used to enlarge natural fractures and reduce the effective normal stress acting across them, in which case a camera can be sent down the drill hole to locate the natural fractures and then a space to either side of said natural fracture is packed, or it can be used to fracture solid rock. In this case, the packers are sent to the starting position in the drill hole and a fracture created, then the packers are moved to a predetermined distance into or out of the drill hole and a new fracture created, and so on until a series of fractures are created at intervals along the drill hole. Typically the predetermined distance or spacing between the fracture treatments is 1 to 10 metres, preferably 3 to 6 metres as dictated by rock strength considerations.

Typically the liquid used is water. It has not generally been found necessary or useful to add surfactants or solid material as is typically done in the petroleum industry. Viscoelastic or pseudoplastic gel fluids can be used in areas near existing cavities to help limit fluid losses and promote extension of the hydraulic fracture into rock that is already fractured to some extent by the proximity of the mine cavity.

In general, a substantial number of drill holes are drilled in the ore body, typically spaced 20 to 100 metres apart, but preferably 20 to 50 metres apart. Thus, the ore body is weakened by an array of fractures when hydraulic fracturing is completed. The fluid pressure in the hydraulic fractures and in the pre-existing fractures in the surrounding rock also act to reduce the effective normal stress across the fracture plane, which further weakens the rock mass.

The block caving process, when applied to an ore body which has been hydraulically fractured is no different to the process when applied to any other suitable ore body. The technique is well known to the person skilled in the art and is discussed, for example, in "Underground Mining Systems and Equipment, 12.14-Block Caving", by D. E. Julin and R. L. Tobie, in the SME Mining Engineering Handbook, L A Given, editor, the disclosure of which is incorporated herein by reference. Typically undercutting is effected by undercutting the ore body while leaving a plurality of pillars which support the ore body, and then blasting the pillars when caving is initiated. The specific arrangements for undercutting and drawing off broken ore in a block caving mining operation varies from operation to operation, but the details are within the comprehension of the person skilled in the art.

BRIEF DESCRIPTION OF THE INVENTION

A preferred embodiment of the invention is described below by way of example and by reference to FIGS. 1 to 3.

DETAILED DESCRIPTION OF THE INVENTION

Figure 1:
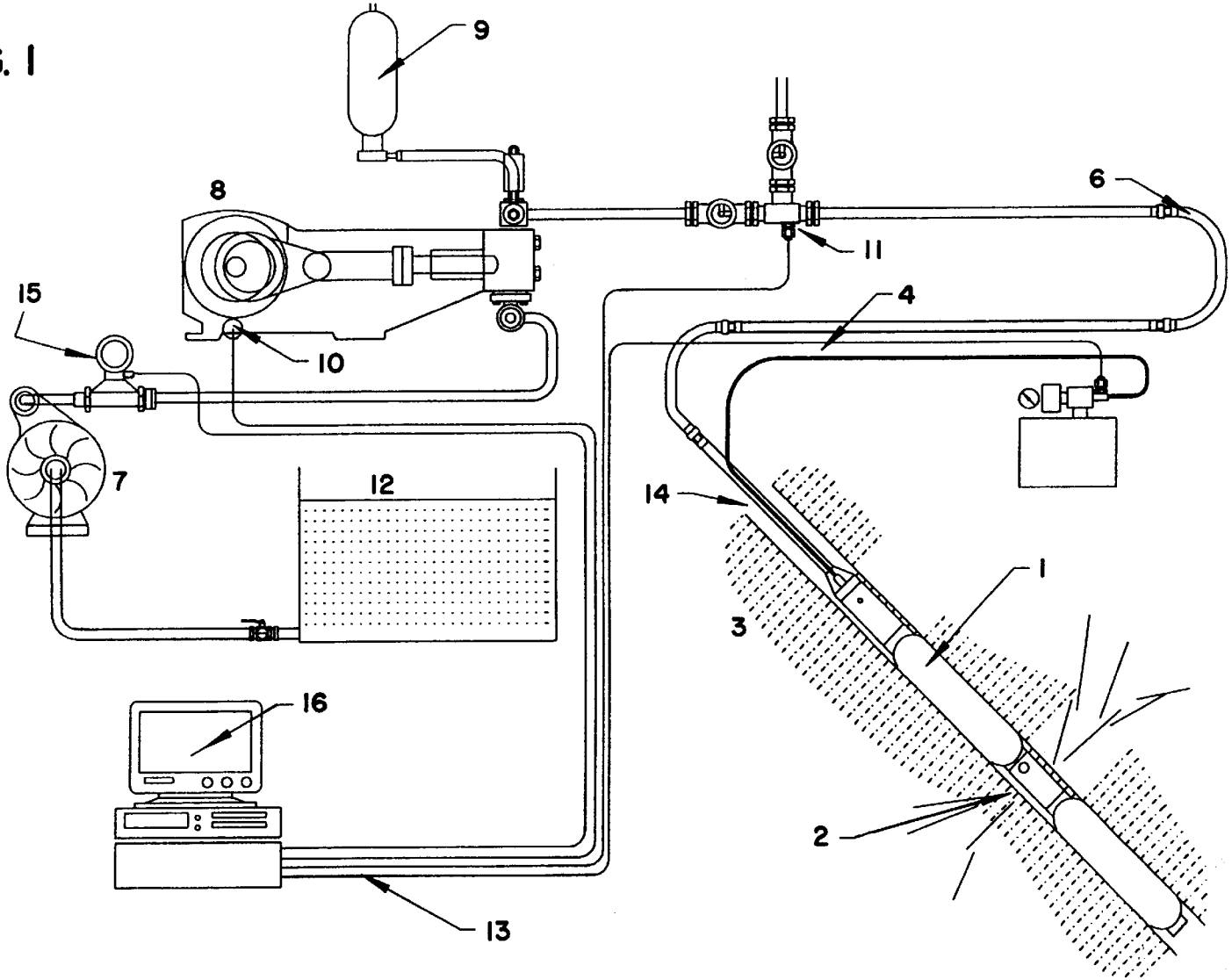
FIG. 1 is a schematic illustration of equipment used to perform hydraulic fracturing.

FIG. 1 shows a drill hole 14 formed in an ore body 3. Two inflated packers 1 are located within the drill hole 14 and define a packer space 2 within the bore hole. The packers 1 are attached to an inflation system 5 by means of line 4. Water is pumped from water supply 12 by means of priming pump 7 and triplex pump 8 via a high pressure hose 6 and a conduit (not shown) through the first packer 1 into space 2. The pressure in the high pressure line 6 is measured by a transducer 11 and the flow rate of water is measured by meter 15. Cables 13 transmit information from flow meter 15 and transducer 11 to a computer 16.

Figure 2:
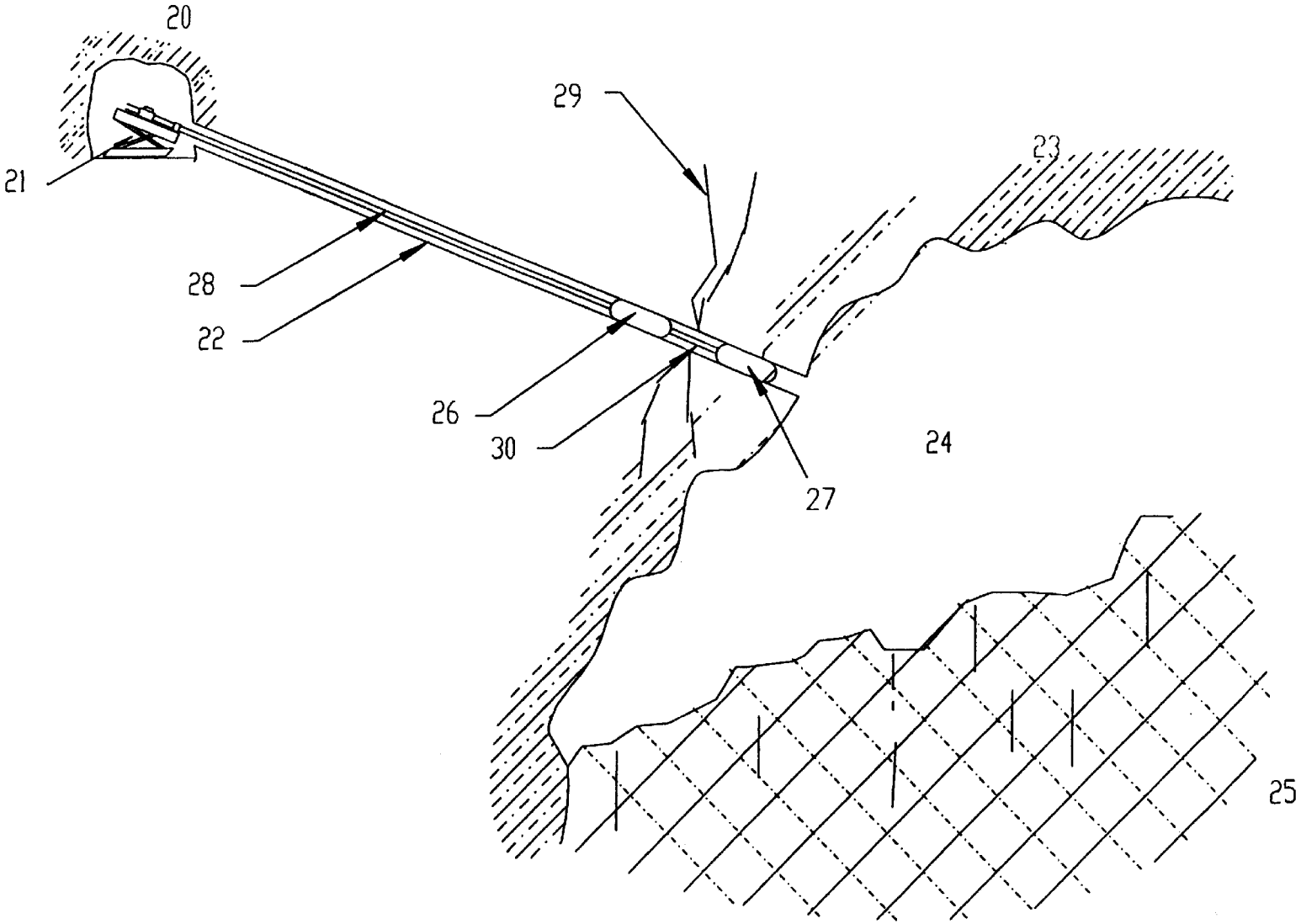
FIG. 2 is a schematic illustration of the use of hydraulic fracturing to increase the rate of rock caving at the Northparkes E26 Mine.

FIG. 2 depicts a mine drive 20 containing a drill rig 21 that has been used to drill a hole 22. Located within the drill hole 22 are packers 26 and 27. Fluid injection line 28 passes down drill hole 22 through a first packer 26 into space 30 between packers 26 and 27. Drill hole 22 passes through an ore body from mine drive 20 out into cavern 24. Water is introduced down the injection line 28 so that the pressure in space 30 builds up rapidly and causes fractures 29 to form in the ore body 23 thereby causing the fractured ore to fall into cavern 24 and form a pile of broken ore 25.

Figure 3:
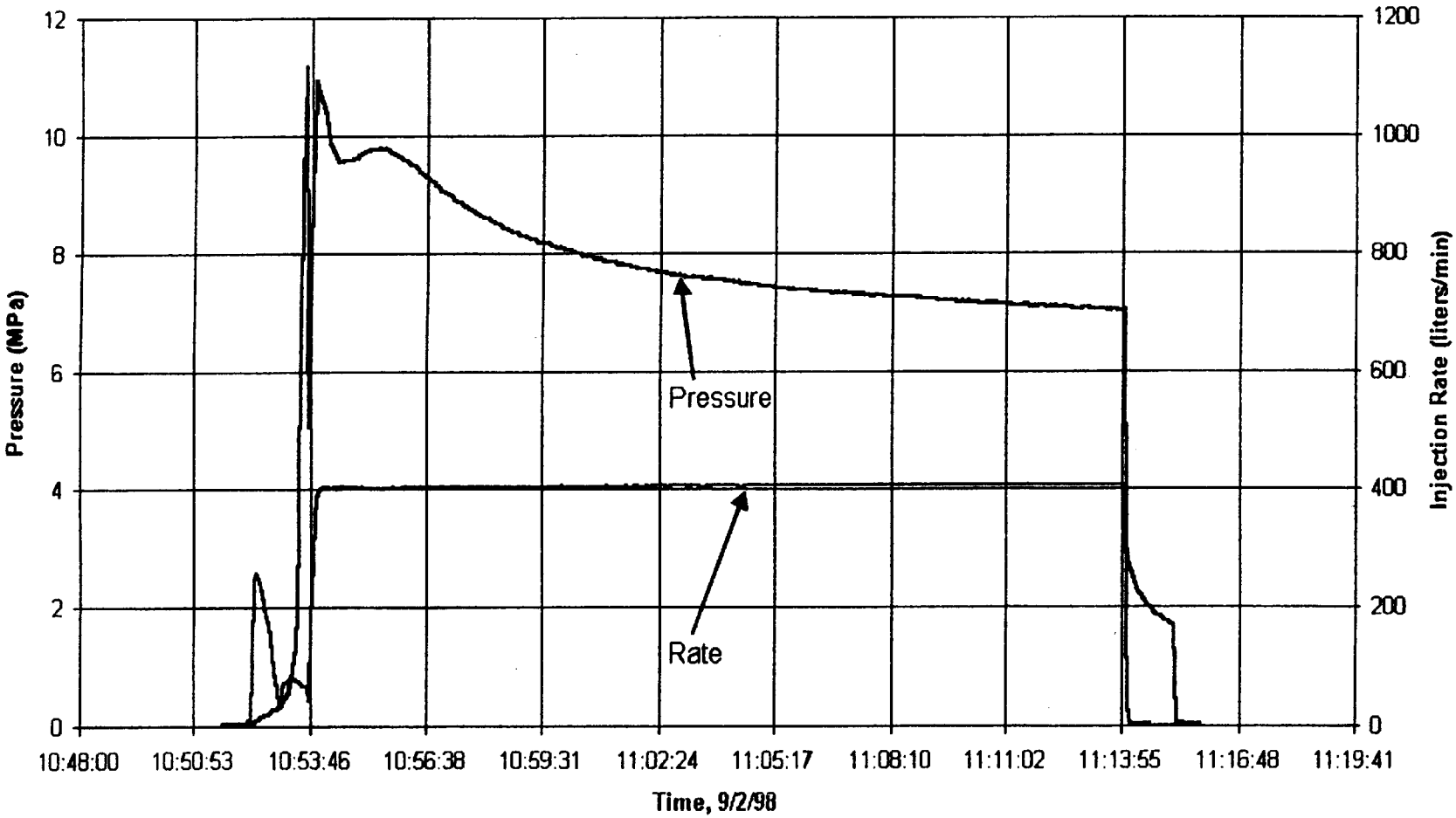
FIG. 3 is a graph showing the pressure recorded during a typical hydraulic fracture at the Northparkes E26 Mine.

FIG. 3 illustrates the pressure and injection rate recorded during hydraulic fracture treatment in bore hole D192 at the Northparkes E26 Mine. 8,000 liters of water was injected at 400 liters per minute to create a hydraulic fracture and weaken the ore body.

EXAMPLE

The process of the present invention has been trialed at the North Parkes mine of North Limited. The Northparkes E26 mine is extracting a porphyry copper and gold deposit employing the technique of block caving. The E26 mine experienced a reduced rate of caving of the rock and an extensive trial of hydraulic fracturing to weaken the rock and increase the caving rate was undertaken. During the trial, over 100 hydraulic fracture treatments were placed from existing exploration drill holes and, as a result of the fracturing work, over 2 million tonnes of additional ore was induced to cave.

The hydraulic fracturing work was carried out from underground on the 1 level exploration drive of the E26 mine. Several hydraulic fractures were placed in each of 10 boreholes. Water was used as the fracturing fluid and an inflatable straddle packer system was deployed by an underground diamond drill rig using AQ-size drill rods. The straddle packer system was used to isolate a section of the hole for each fracture treatment. Hydraulic fractures were placed along each hole at intervals of 3 or 6 meters. A triplex pump powered by a diesel engine provided the high pressure required for the fracturing.

Injection rates were typically maintained at between 400 and 450 liters per minute and injection pressures varied from 20 MPa to less than 2 MPa. Pressure and injection rate data were recorded for each treatment by a computer data acquisition system. A typical record showing time of injection, injection rate, and pressure used during one treatment is shown in FIG. 3.

The trend of initially higher pressure declining throughout the injection period, as shown in FIG. 3, was found to be typical. Seismic monitoring of the rock response to the hydraulic fracturing was carried out by an existing array of accelerometers and provided direct confirmation that the hydraulic fracturing work was weakening the rock and producing deformation in the rock around the mine leading to enhanced caving rates.

Fracturing pressures near the existing mine cave were lower while pressure experienced some distance away from the cave were higher. The degree of stress-induced fracturing, together with lower magnitude stresses near the cave, explain this behaviour.

What is claimed is:

1. A method of mining an ore body comprising the steps of:

(i) packing a bore or fissure in an ore body with packers to seal off a packed space defined by the packers and walls of the bore or fissure;

(ii) introducing fluid into the packed space at such a rate that it causes pressure to rapidly build up in the packed space and causes a substantial portion of the surrounding ore body to fracture;

(iii) allowing the surrounding ore body to cave into a suitable space; and (iv) recovering ore from the suitable space.

2. A method of mining an ore body according to claim 1 wherein the fluid is introduced at a rate from 100 to 4000 liters per minute.

3. A method of mining an ore body according to claim 2 wherein the pressure in the packed space reaches a level in a range from 2 to 50 megapascals.

4. A method of mining an ore body according to claim 1 wherein the pressure in the packed space reaches a level in a range from 2 to 50 megapascals.

5. A method of mining an ore body according to claim 1 wherein the packers comprise a pair of inflatable packers spaced apart by a predetermined distance and held in this configuration by a spacer.

6. A method of mining an ore body according to claim 5 wherein one of the packers has a conduit passing therethrough so that the fluid can be introduced into the packed space.

7. A method of mining an ore body according to claim 1 wherein the fluid is selected from one of water and a water based polymer gel.

8. A method of mining an ore body according to claim 1 wherein steps (i) and (ii) are repeated a number of times in bores spaced from 20 to 100 metres apart before subsequent steps are implemented.

9. A method of mining an ore body according to claim 1 wherein steps (i) and (ii) are repeated a number of times in a bore at intervals of 1 to 10 metres.

10. A method of mining an ore body according to claim wherein the intervals are from 3 to 6 meters.

11. A method of mining an ore body according to claim 1 wherein the suitable space into which the ore body caves is formed by initially undercutting.

12. A method of mining an ore body comprising the steps of:

(i) packing a bore or fissure in an ore body with packers to seal off a packed space defined by the packers and walls of the bore or fissure, and wherein the ore body is undercut, with a suitable space being defined by at least a portion of the undercut;

(ii) introducing fluid into the packed space at such a rate that it causes pressure to rapidly build up in the packed space and causes a substantial portion of the surrounding ore body to fracture;

(iii) allowing the surrounding ore body to cave into the suitable space; and (iv) recovering ore from the suitable space.

13. A method of mining an ore body comprising the steps of:

(i) undercutting an ore body to form at least a portion of a suitable space into which a portion of the ore body can cave;

(ii) packing a bore or fissure in the portion of the ore body with packers to seal off a packed space defined by the packers and walls of the bore or fissure;

(iii) introducing fluid into the packed space at such a rate that it causes pressure to rapidly build up in the packed space and causes the portion of the ore body to fracture;

(iv) allowing the portion of the ore body to cave into the suitable space; and (v) recovering ore from the suitable space.

* * * * *

UNITED STATES PATENT AND TRADEMARK OFFICE

CERTIFICATE OF CORRECTION

PATENT NO. : 6,123,394
DATED : September 26, 2000
INVENTOR(S) : Jeffrey

It is certified that error appears in the above-identified patent and that said Letters Patent is hereby corrected as shown below:

Column 2,
Line 19, "lock" should read -- block --

Column 4,
Line 12, "BRIEF DESCRIPTION OF THE INVENTION" should read -- BRIEF DESCRIPTION OF THE DRAWINGS --

Column 6, claim 10,
Line 18, "to claim wherein" should read -- to claim 9 wherein --

Signed and Sealed this

Sixteenth Day of April, 2002

*Attest:*

*Attesting Officer*

JAMES E. ROGAN
*Director of the United States Patent and Trademark Office*